US009067255B2

(12) United States Patent
Fries et al.

(10) Patent No.: US 9,067,255 B2
(45) Date of Patent: Jun. 30, 2015

(54) BENDING APPARATUS FOR ROD-SHAPED WORKPIECES

(75) Inventors: Stefan Fries, Reutlingen (DE); Joerg Moeck, Sonnenbuehl (DE); Frank Weiblen, Metzingen-Neuhausen (DE); Harry Schweikardt, Sonnenbuehl (DE)

(73) Assignee: Wafios Aktiengesellschaft, Reutlingen (DE)

( * ) Notice: Subject to any disclaimer, the term of this patent is extended or adjusted under 35 U.S.C. 154(b) by 434 days.

(21) Appl. No.: 13/543,149

(22) Filed: Jul. 6, 2012

(65) Prior Publication Data

US 2013/0008223 A1 Jan. 10, 2013

(30) Foreign Application Priority Data

Jul. 8, 2011 (DE) ..... 10 2011 106 942

(51) Int. Cl.
*B21F 1/00* (2006.01)

(52) U.S. Cl.
CPC .. *B21F 1/00* (2013.01); *B21F 1/006* (2013.01)

(58) Field of Classification Search
CPC ..... B21F 1/00; B21F 1/006
USPC ..... 72/324, 338, 293, 294, 306, 312, 316, 72/318, 380, 388, 389, 418, 387, 129, 131, 72/132, 419, 420, 421
See application file for complete search history.

(56) References Cited

U.S. PATENT DOCUMENTS

| | | | | |
|---|---|---|---|---|
| 1,983,618 | A | | 12/1934 | Lamond |
| 2,464,510 | A | | 3/1949 | Hull |
| 3,922,901 | A | * | 12/1975 | Hillegas et al. ..... 72/298 |
| 4,102,169 | A | * | 7/1978 | Koser ..... 72/128 |
| 4,799,373 | A | | 1/1989 | Benton |
| 4,838,062 | A | | 6/1989 | Prenn |
| 5,193,378 | A | | 3/1993 | Ritter et al. |
| 5,709,121 | A | | 1/1998 | Camping |
| 6,508,097 | B2 | | 1/2003 | Ose |
| 6,708,548 | B2 | | 3/2004 | Ehrke et al. |
| 7,237,420 | B2 | | 7/2007 | Berghaus |
| 2003/0089153 | A1 | | 5/2003 | Etienne |

(Continued)

FOREIGN PATENT DOCUMENTS

| | | |
|---|---|---|
| CH | PS 477 929 | 10/1969 |
| CN | 2352285 Y | 12/1999 |
| CN | 2526103 Y | 12/2002 |

(Continued)

*Primary Examiner* — David B Jones
(74) *Attorney, Agent, or Firm* — Christensen Fonder P.A.

(57) ABSTRACT

A bending device for rod-shaped workpieces having a bending head with a mandrel rotatable about a rotation axis, a cutting device for cutting the respective workpiece in a cutting plane, and a feed and straightening device for feeding the workpieces to the bending head, the cutting device capable of being moved along a travel path in the feed direction of the workpieces, with the bending head capable of being shifted between an operating position in which it is moved towards the workpiece and an inactive end position remote therefrom, the bending head, in order to assume its operating position, can be moved into the travel path of the cutting device, whereas, when assuming its inactive end position, it is positioned outside the travel path of the cutting device, and, when the bending head is situated in its inactive end position, the cutting device can be moved downstream on its travel path at least partly over the area of the operating position of the bending head.

18 Claims, 3 Drawing Sheets

(56) References Cited

U.S. PATENT DOCUMENTS

| | | | | |
|---|---|---|---|---|
| 2004/0250591 | A1* | 12/2004 | Del Fabro et al. | 72/294 |
| 2010/0307213 | A1 | 12/2010 | Veit et al. | |

FOREIGN PATENT DOCUMENTS

| | | | |
|---|---|---|---|
| DE | 26 29 796 | | 12/1980 |
| DE | 35 46 449 | A1 | 9/1986 |
| DE | 690 03 116 | T2 | 1/1994 |
| DE | 60103632 | T2 | 6/2005 |
| DE | 60219651 | T2 | 12/2007 |
| DE | 602 20 445 | T2 | 1/2008 |
| DE | 10 2009 024 075 | A1 | 12/2010 |
| EP | 0 231 092 | A2 | 8/1987 |
| EP | 0 417 703 | A2 | 3/1991 |
| EP | 0 419 443 | A1 | 3/1991 |
| EP | 0 519 865 | A1 | 12/1992 |
| EP | 0 379 030 | B1 | 9/1993 |
| EP | 1 396 296 | A1 | 3/2004 |
| EP | 1 272 293 | B1 | 6/2004 |
| EP | 1 434 660 | B1 | 4/2007 |
| EP | 1 467 827 | B1 | 5/2007 |
| FR | 2.231.449 | | 12/1974 |
| FR | 2 602 160 | | 2/1988 |
| JP | 3-169433 | | 7/1991 |
| WO | WO 99/26739 | A1 | 6/1999 |

* cited by examiner

BENDING APPARATUS FOR ROD-SHAPED WORKPIECES

The present application claims priority to German Patent Application No. 10 2011 106 942.2 filed on Jul. 8, 2011, which said application is incorporated by reference in its entirety herein.

FIELD OF THE INVENTION

The present invention relates to a bending apparatus for rod-shaped workpieces.

BACKGROUND OF THE INVENTION

With bending devices it is frequently desired that there be only a short, straight end piece between the cutting plane and the last bend which the bending head produces.

A bending device is known from EP 0 379 030 B1 (corresponding to DE 690 03 116 T2) in which upstream of the bending head, a cutting device is provided that can be moved in feed direction of the workpiece. It is thus possible to vary the distance between the end of the workpiece produced after cutting and the bending head. However, with this known bending machine, the cutting device, even in its position moved furthest towards the bending head, is still a clear distance from the bending head. As a result, there is in every case a relatively long straight end piece of the workpiece between the cutting point and the bending head.

In DE 10 2009 024 075 A1, a bending device for rod-shaped workpieces is described in which the cutting device mounted upstream of the bending head can likewise be shifted in feed direction of the workpieces. The bending head is attached to the front end of the machine frame, wherein the cutting device can be moved up to a frontmost position in which it is situated immediately in front of the bending head. Although the cutting plane of the cutting device can thus be moved up fairly close to the bending head, in different cases of application this still leads to a straight end piece which turns out to be longer than desired.

In order to still further shorten such relatively short straight end pieces between the last bend in the workpiece and its end, with known bending devices the workpiece has previously been moved backwards via the feeder (or a movable feeder) and the last bend already produced positioned at the cutting unit, in order to make a cut in this position. However, the required reversal of the conveyance direction of the workpiece leads to an undesired reduction in the machine's throughput. In addition, some bending devices also have no movable feeder, in which case it is not even possible to convey the workpiece backwards. Moreover, a rearward conveyance of the workpiece via the feeder is also very problematic when large workpiece diameters are used.

SUMMARY OF THE INVENTION

As a result of the problems in the prior art, an object of the present invention is to provide a bending device such that it is also possible to cut off the workpiece quite close to its last bend with no, or only an extremely short, straight end piece, without the need for a movement of the workpiece.

According to certain aspects of the present invention, this objective is achieved with a bending device for rod-shaped workpieces having a bending head, which in order to assume its operating position, can be moved into the travel path of the cutting device, whereas, after assuming its inactive end position, it lies completely outside the travel path of the cutting device, and in that, when the bending head is situated in its inactive end position, the cutting device can be moved downstream on its travel path at least partly over the area of the operating position of the bending head, i.e. the area of the travel path which the bending head occupies in its operating position.

According to certain aspects of the present invention, a bending device for rod-shaped workpieces has a bending head with a mandrel rotatable about a rotation axis, a cutting device for cutting the respective workpiece in a cutting plane, and downstream of the bending head, a feed and straightening device for feeding the workpieces to the bending head, wherein the cutting device can be moved along a travel path in feed direction of the workpieces and the bending head can be shifted between an operating position in which it is moved up to the workpiece and an inactive end position remote therefrom.

With the bending device according to certain aspects of the present invention, an arrangement is thus used in which the bending head can be shifted between an operating position in which it can process the workpiece and in which it protrudes into the travel path of the cutting device, and an inactive end position remote from the latter, wherein, when it assumes the inactive end position, it lies outside the travel path of the cutting device. The travel path of the cutting device extends downstream at least partly into the area of the operating position of the bending head or even beyond this area.

In certain aspects of the present invention, if the bending head is in its operating position, it protrudes into an area of the travel path of the cutting device, with the result that in this situation the cutting device cannot be moved along its entire travel path, in order not to collide with the bending head in its operating position. However, if the bending head has been moved out of its operating position into its inactive end position, in which it is wholly situated outside the travel path of the cutting device, the cutting device can then also be moved as far as the downstream end of its travel path (seen in feed direction of the workpiece). This configuration makes it possible, after moving the bending head into its inactive end position, to move the cutting device (at least) partly over the area of the operating position of the bending head so far that it has moved right up to the beginning of the last bend formed by the bending head on the workpiece, and only there can it be activated for cutting.

The bending device according to certain aspects of the present invention is particularly preferably designed such that the cutting device can be moved at least so far downstream over the area of the operating position of the bending head, i.e. the area occupied by the bending head in its operating position, that it can reach a movement end position in which the cutting plane lies downstream of the position assumed by the rotation axis of the mandrel of the bending head when the latter has been deployed into its operating position. In certain aspects, this embodiment allows the cutting device to be moved so far that it can quite safely be moved up to the beginning of the last bend in the workpiece formed by the bending head.

In further certain advantageous aspects of the present invention, the bending device can be provided such that the cutting device can travel over the whole of the area of the operating position of the bending head when the latter is situated in its inactive end position, particularly preferably that the cutting device can even be moved further downstream beyond the area of the operating position of the bending head, particularly preferably it can even be moved as far as the end of the machine frame. Quite specific advantages of a bending device according to the present invention can be achieved with these embodiments.

In certain aspects of the present invention, if the cutting device is arranged so that it can travel over the whole of the area of the operating position of the bending head, this provides the possibility that a workpiece can be lowered only in front at the end face of the machine, for which the bending part in question is moved out forward beyond the bench, the cutting device is moved as far as the end of its travel path over the area of the operating position of the bending head and optionally even as far as the end of the machine frame, thus as far as the edge of the bench, and only there is the cut activated (wherein in this case the bench recess must of course be correspondingly adapted).

Completely different positions for depositing the processed workpieces can thus be achieved with the bending device according to the present invention.

In certain aspects of the present invention, a further advantageous possibility is also provided if, before cutting, the workpiece is conveyed still further forward beyond the supporting bench of the machine onto a further support bench or other reception device and only then is the cutting device activated e.g. in a middle position or at the end of the bench, thus allowing particularly easy removal of the workpieces over the end face of the bending device.

In certain aspects of the bending device according to the present invention, because by moving the bending head out of the travel path of the cutting device the possibility is created (solely by moving the cutting device into the area of the operating position of the bending head, or even beyond the latter) to place the cut where it is desired without the possibility of a collision with the bending head, workpieces with cuts that take place immediately at the last bend or very shortly before it can be produced without difficulty and without the workpiece having to be moved in any way. Since it is completely unnecessary to reverse the movement of the workpiece, not only is it possible to achieve a somewhat higher workpiece throughput with the bending device according to the present invention, but it can also be used for workpieces with relatively large diameters in the case of which a reversal of the movement of the feeder was previously simply not possible.

In certain aspects of the present invention, the bending head can be brought from its active operating position into its inactive end position (and vice versa) in any suitable manner. However, it is quite particularly preferred if the bending head can be moved by being made to travel in the direction of the rotation axis of the mandrel out of its operating position into its inactive end position or vice versa. Then, after the last bending process has been carried out, the mandrel can quite simply be moved perpendicularly out of the previous bending plane and brought into its other end position without further corrective movements of the mandrel being required in order to allow departure from the bending plane without changing the position of the workpiece.

A quite particularly preferred embodiment of the bending device according to certain aspects of the present invention also provides that the cutting device comprises a support arm aligned perpendicularly to the feed direction of the workpiece, which support arm has a movable cutting blade and a stationary counter-blade fixed to the support arm in the feed direction of the workpiece directly in front of this cutting blade, wherein the cutting plane is established between the two adjacent blades. Furthermore, the support arm protrudes into the feed axis of the respectively conveyed workpiece and the workpiece coming from the feed device can be cut through while passing the cutting blade and the counter-blade in the cutting plane established between the two. This results in a relatively simply structured embodiment of the bending device according to the present invention, which can be produced inexpensively and allows a problem-free implementation of the method according to the present invention.

According to certain aspects of the present invention, a particularly preferred embodiment of the bending device furthermore comprises the bending head being situated in a bending-head housing from which it can be moved out in order to assume its active operating position and into which it can be moved in order to assume its inactive end position. With this embodiment, if it has assumed its inactive end position inside the bending-head housing, outside the latter, where the bending head is moved out in its active operating position, the cutting device can be moved on top of the bending-head housing, while the bending head is accommodated, protected from the processes, inside the bending-head housing during the movement of the cutting device.

With such an embodiment, the support arm of the cutting device is preferably movably supported on linear guides at its end area facing away from the supplied workpiece against a rear wall of the machine frame or of the bending-head housing parallel to the workpiece. Thus, when displaced by the bearing on the back of the machine frame or bending housing, it can be guided precisely parallel to the workpiece, while the support arm, when moved, is guided above the machine frame or the bending-head housing respectively, at a distance therefrom and at the same time the area of the operating position of the bending head can be traversed without difficulty.

In certain aspects of the present invention, the bending-head housing can preferably be formed such that it can also still be movably attached to the machine frame parallel to the feed direction of the workpiece.

In certain aspects of the present invention, the bending apparatus for rod-shaped workpieces comprises a bending head having a mandrel rotatable about a rotation axis, the bending head moveable between an operating position, in which the bending head comprises an operating area and operably engages the respective workpiece, and an inactive end position remote therefrom, a feed device and a straightening device, the feed and straightening devices operably located in an axial direction from the bending head, and a cutting device for cutting the respective workpiece in a cutting plane, wherein the cutting device is configured such that it is moveable along a travel path in a feed direction of the workpieces from the feed and the straightening devices to the bending head, and wherein the bending head in the operating position is located in the travel path of the cutting device, and the bending head in the inactive end position is positioned outside the travel path of the cutting device such that the cutting device can be moved in a downstream direction on the travel path toward the location of the bending head such that the cutting device is capable of being located at least partly within the operating area of the bending head.

In certain aspects, the cutting device is moveable in the downstream direction such that the cutting plane is located upstream of the position of the rotation axis of the mandrel of the bending head in its operating position.

In certain aspects, the cutting device is moveable in the downstream direction such as to completely traverse the operating area of the bending head when the bending head is in the inactive end position.

In certain aspects, the cutting device is moveable in the downstream direction such that at least a portion of the cutting device is located beyond the operating area of the bending head.

In certain aspects, the cutting device is moveable in the downstream direction as far as an end of a machine frame of the bending apparatus.

In certain aspects, the bending head is moveable between the operating position and the inactive end position along a direction of the rotation axis of the mandrel.

In certain aspects, the cutting device comprising a support arm aligned generally perpendicular to the feed direction of the workpiece In certain aspects, the support arm has a movable cutting blade, and a stationary counter-blade, the cutting blade and the stationary counter-blade defining the cutting plane.

In certain aspects, the stationary counter-blade is fixed to the support arm in the feed direction of the workpiece.

In certain aspects, the support arm protrudes as far as the respectively conveyed workpiece.

In certain aspects, the support arm of the cutting device is movably supported on one or more linear guides.

In certain aspects, the bending head is situated in a bending-head housing from which it can be moved out in order to occupy its operating position and into which it can be moved to occupy its inactive end position.

In certain aspects, the cutting device comprising a support arm aligned generally perpendicular to the feed direction of the workpiece, wherein the support arm is movably supported on one or more linear guides proximally located on a machine frame of the bending apparatus.

In certain aspects, the bending-head housing is movably attached to the machine frame parallel to the feed direction of the workpiece.

DESCRIPTION OF THE DRAWINGS

The present invention is explained in more detail in principle by way of example with reference to the drawings, wherein.

DETAILED DESCRIPTION

Figure 1:
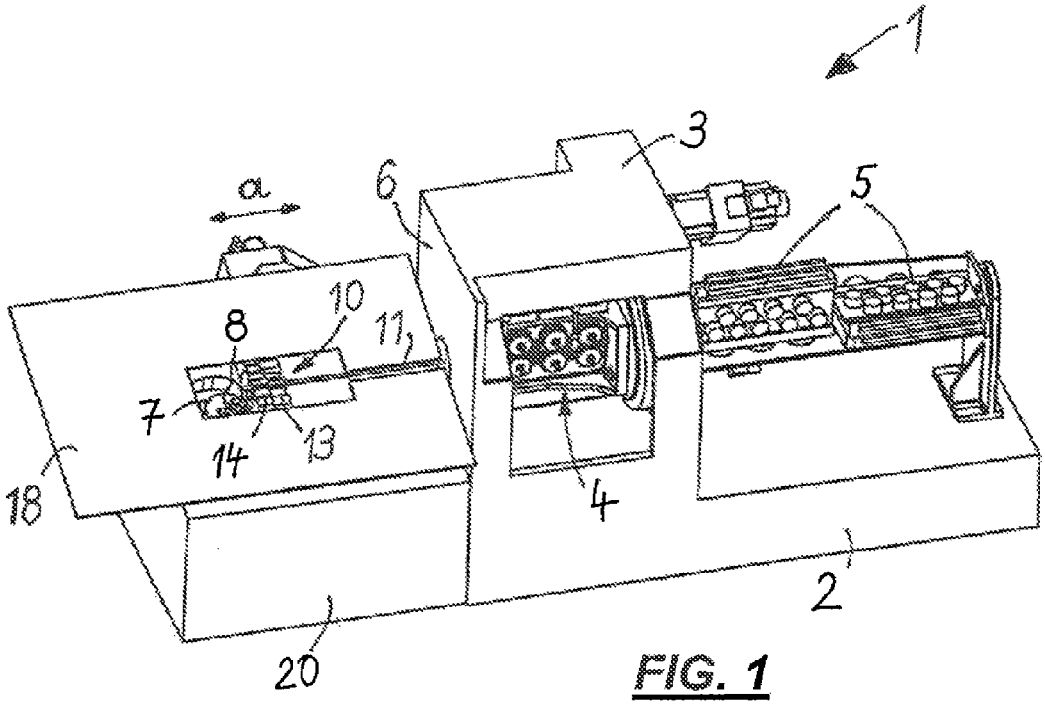
FIG. 1 shows a top diagrammatic perspective view of a bending device according to the present invention, the bending device having a supporting bench viewed at an angle from above from the front.
Figure 2:
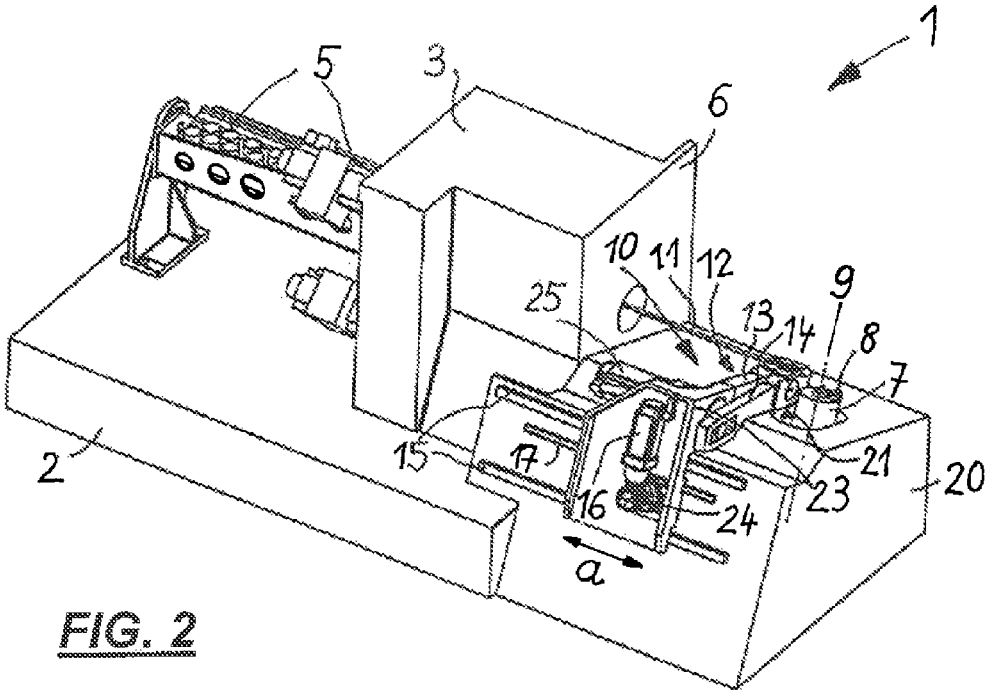
FIG. 2 shows a perspective view of the bending device in FIG. 1, but viewed at an angle from the back and without a supporting bench.
Figure 3:
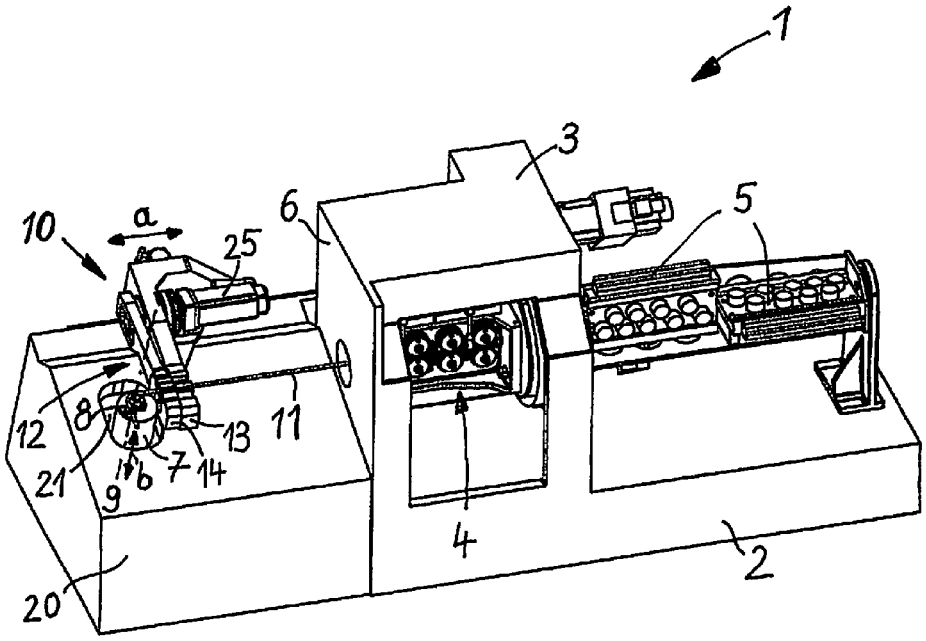
FIG. 3 shows a top perspective view of the machine from FIGS. 1 and 2, the bending device having the supporting bench removed and the bending device illustrated in the configuration after a bending process.
Figure 4:
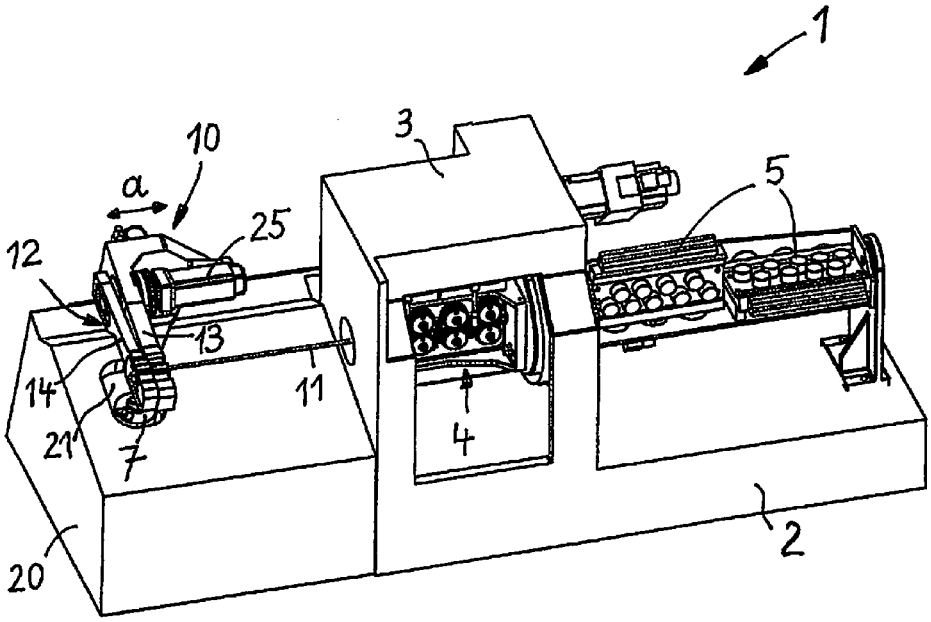
FIG. 4 shows a top perspective view from FIG. 3, but in the cutting position.

FIGS. 1 to 4 show a diagrammatic perspective representation of a bending device 1, wherein in the view in FIGS. 1, 3 and 4 the chosen viewing direction is at an angle from above from front to back, and in the view in FIG. 2 the chosen viewing direction is at an angle from above from back to front.

The bending machine 1 comprises a machine frame 2 and a housing 3 mounted thereon, in which a feed device 4 in the form of a roller feed with three pairs of series-connected rollers is rotatably mounted.

Two straightening devices 5 offset by 90° to each other are situated at the back of the housing 3, are connected to the rotatable feed device 4, and can be twisted with the latter about the central axis of a workpiece 11 in the form of a wire.

Arranged in front of the end face 6 of the housing 3 are a bending head 7, bearing a mandrel 8 at the top, which is rotatable about a rotation axis 9 (FIGS. 2 and 3), as well as a cutting device 10 which can be moved along a travel path in direction a (workpiece-feed direction).

In the representation of FIG. 1, an inclined supporting bench 18, which supports the workpiece 11 during production, rests on top of a bending-head housing 20. Corresponding to the inclination of the supporting bench 18, the bending head 7 and the cutting device 10 are also arranged equally inclined to the horizontal, in order that, after cutting, the finished workpieces 11 can drop down. The supporting bench 18 (not shown in detail in the figures) is height adjustable, and the entire bending-head housing 20 can also be moved parallel to the longitudinal direction of the workpiece 11 (also not shown in the figures).

To show the structure of the bending device 1 clearly, the supporting bench 18 is no longer shown in FIGS. 2 to 7.

The bending head 7 is mounted in the bending-head housing 20, which has an opening 21 on top through which the bending head 7 can be moved into the bending-head housing 20 or moved out of it. The outward and/or inward movement takes place in a direction b (cf. FIG. 3), namely in the direction of the rotation axis 9, perpendicular to the wire 11. In certain aspects, as illustrated in FIG. 3, the rotation axis 9 and/or direction b are generally perpendicular to the travel path direction a.

Also situated on the bending-head housing 20 is the cutting device 10 which, as shown by FIG. 2, comprises a support arm 12 which has a movable cutting blade 14 and, directly next to the latter, a fixed counter-blade 13. The two blades 13, 14 between them establish a cutting plane 22, as can best be seen from the representations in FIGS. 5 to 7. The movable cutting blade 14 is driven via a motor 25. In certain aspects, as illustrated in FIG. 3, the cutting plane 22 is parallel to the rotation axis 9 and/or direction b, and when moved in travel path direction a as shown in FIG. 4, can be in the same plane as rotation axis 9. Thus, in certain aspects, the cutting plane 22 is generally perpendicular to the travel path direction a.

Figure 5:
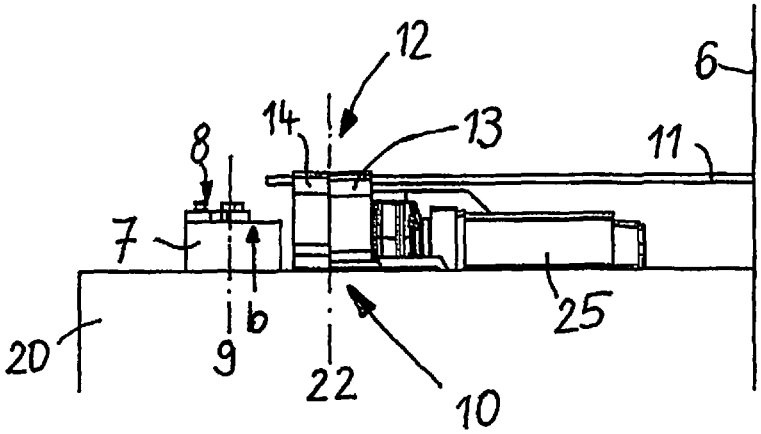
FIG. 5 shows a diagrammatic view of a detail of the upper part of the bending device from FIGS. 1 to 4, viewed in the direction parallel to the supporting bench, before the workpiece is fed into the bending head.
Figure 6:
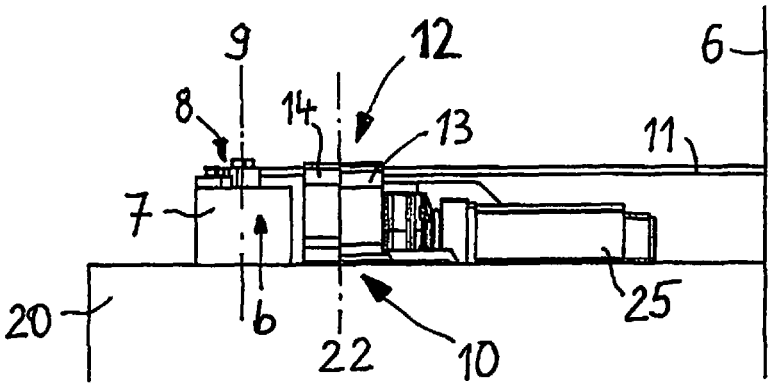
FIG. 6 shows a diagrammatic view from FIG. 5, but after a cutting process.
Figure 7:
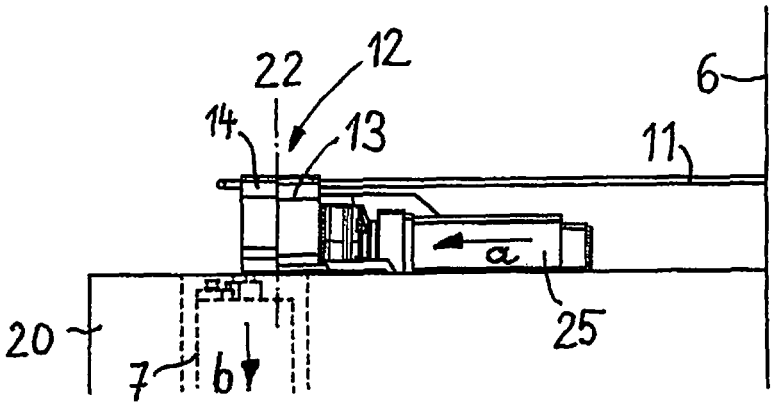
FIG. 7 shows a diagrammatic view from FIG. 5, but with cutting device located in the cutting position.

FIGS. 5 to 7 show quite diagrammatically and in a viewing direction parallel to the supporting bench 18 a detailed view of the upper part of the bending-head housing 20 with different positions of the bending head 7.

FIG. 5 shows the situation before the operating position of the bending head 7 is reached, thus before the workpiece 11 is fed into the bending tool.

FIG. 6 shows the situation in which the bending head 7 is in its operating position and has made a bend in the workpiece 11 (as shown in FIG. 3).

Finally, FIG. 7 shows how the bending head 7 has travelled into the bending-head housing 20 into its inactive end position and the cutting device 10 has already travelled over a section of the area of the operating position of the bending head 7.

As is shown clearly by FIGS. 5 to 7, the workpiece 11 runs past the two blades 13, 14 in two grooves (not shown) each attached to the two blades 13, 14, aligned relative to each other and in feed direction of the workpiece 11 and is sheared upon activation of the cutting device 10 when the movable cutting blade 14 moves relative to the stationary counter-blade 13 in the cutting plane 22.

In certain aspects of the present invention, the bending device 1 is a wire bending machine, the feeder of which continuously pulls in the workpiece 11, namely a wire, from a coil (not shown) through the straightening units 5. The rotatable design of the feed device 4 and the straightening devices 5 allows the wire 11 to be bent in different planes.

As FIG. 2 shows, the support arm 12 of the cutting device 10 is attached at its end area lying on the back of the bending-head housing 20 to a support 23 which for its part is movably supported on two parallel linear guides 15.

Shown between the linear guides 15, parallel thereto, is a rack 17, represented only quite diagrammatically in FIG. 2, with which a gear 24 engages, which for its part can be driven in both rotation directions via a motor 16 fastened to the support 23 and wherein the support 23 with the support arm 12 and the blades 13, 14 can be moved along the linear guides 15.

If the cutting device 10 is moved along the linear guides 15, it moves on top of the bending-head housing 20, at a slight distance therefrom, along a travel path that runs parallel to the feed direction of the wire 11.

In order to carry out the bending processes, the bending head 7 with the mandrel 8 can be moved out of the bending-head housing 20 through the opening 21 along direction b into an outer end position which is to be called the "operating position" and in which it can enter into effective engagement with the mandrel 8 in order to carry out the desired bending processes with the wire 11. When moving out into this operating position, the wire 11 is fed into the bending tool.

This deployed operating position is shown in FIGS. 3 and 6; however, in each case already at a point in time after a bending process has been carried out.

If several bending processes, between which the cutting device 10 is not activated, are carried out in succession, the bending head 7 can be moved out of its deployed operating position (FIG. 6) into an intermediate position lying approximately vertically away from the wire 11 (direction b) as shown in FIG. 5: however, in this intermediate position, the top of the bending head 7 with the mandrel 8 still lies outside the bending-head housing 20 and is only so far away from the wire 11 that there is just no longer any effective engagement between the bending tool and the wire 11. The wire 11 can then be advanced unimpeded and, as soon as a new bending process is required, the bending head 7 is returned to its operating position (in direction b) (FIG. 6).

However, if the bending head 7 is now no longer required during the processing of the respective workpiece 11, but the cutting device 10 is ready for activation, the bending head 7 is retracted into the bending-head housing 20 in direction b, vertically away from the wire 11 and through the opening 21, until it assumes its inactive end position in the retracted state.

The consequence of this retraction of the bending head 7 into the bending-head housing 20 is that the bending head 7 has completely disappeared from the travel path along which the cutting device 10 can be moved in feed direction of the wire 11 at the bending-head housing 20, with the result that the cutting device 10 can now be moved with its support arm 12 protruding as far as the wire 11 and its blades 13, 14 into the area of the opening 21, even into the area occupied by the bending head 7 in its deployed operating position, without the risk of a collision of the cutting device 10 with the bending head 7.

The linear guides 15 correspondingly extend as far forward at the back of the bending-head housing 20 as a movement of the cutting device 10 downstream is desired. In the representation shown in FIG. 2 the length of the linear guides 15 is chosen such that the cutting device 10 can be moved over the entire width of the opening 21 and thus also over the entire area of the effective engagement of the bending head 7 along its travel path if the bending head 7 is in its retracted inactive end position.

Equally, the linear guides 15 could however also be made so long (not shown in the figures) that they actually extend beyond the area of the opening 21 and thus the area of the effective engagement of the bending head 7 as far as the end face of the entire machine, in order, if desired, to move the bent part produced from the wire 11 before cutting forward only as far as the end of the supporting bench 18 and to activate the drive 25 of the cutting device 10 only at the edge of the supporting bench 18, after which the produced part can be immediately removed on the front at the bending device 1.

If the bending head 7 has been retracted into its inactive end position in the bending-head housing 20 in direction b and the cutting device 10 has then travelled over the entire open opening 21 in direction a, a situation results as shown in FIG. 7. In this representation the cutting plane 22 is situated only very slightly upstream of the point where, with the bending head 7 deployed into its operating position, the rotation axis 9 of the mandrel 8 would be situated.

If the representations in FIGS. 3 and 4 are compared with each other, then in FIG. 3 the bending head 7 has made a bend of 90° (downwards in the graphic representation in FIG. 3) in the wire 11 and the cutting device 10 lies immediately in front of the opening 21 of the bending-head housing 20, i.e. only a very short distance from the bending head 7 which is in its deployed operating position.

FIG. 4 shows the situation when the wire 11 provided with the bend according to FIG. 3 is to be cut off quite close to the beginning of the bend produced.

For this purpose, as shown in FIG. 4, the bending head 7 has been lowered through the opening 21 into its retracted, inactive end position inside the bending-head housing 20 perpendicular to the wire 11 (in direction b), after which the cutting device 10 is retracted in direction a with the two blades 13, 14 into the area occupied by the bending head 7 in its operating position (FIG. 3), so far that the bent leg of the wire 11 has come to rest against the front face of the movable blade 14. In this position the cutting plane 22 is situated very close to the point at which the bend made in the wire 11 begins. If the cutting process is now started, this front, bent part of the wire 11 falls onto the inclined surface of the bending-head housing 20, from which it can drop down.

If, however, during this process the cutting plane is to lie exactly at the point where the last bend of the previously bent wire 11 begins, i.e. so far as possible without a short straight piece of wire in front, then before the activation of the cutting device 10 by rotation of the feeder the bent leg of the wire 11 is swivelled upwards, with the result that it no longer lies against the front side of the movable blade 14, lying in front. The support arm 12 can thereby be moved downstream until the cutting plane 22 established between the two blades 13, 14 has moved up to the beginning of the last bend of the wire 11, after which the cutting device 10 is then activated.

In order to ensure an undisturbed and continuous operation with the bending device 1 shown in the figures, the bending device 1 is connected to a machine controller (not shown in the figures) which is designed such that it allows a retraction of the cutting device 10 into the area occupied by the bending head 7 in its deployed operating position only when the bending head 7 is retracted into its inactive end position in the bending-head housing 20, in which, as shown by the figures, in particular FIGS. 5 to 7, it is located wholly under the beam or support arm 12 of the cutting device 10, with the result that in this way a collision of the cutting device 10 retracting into the operating position of the bending head 7 (or of its support arm 12 with the blades 13, 14) with the bending head 7 moved from its operating position is safely avoided.

With the bending machine according to the present invention an arrangement is in principle achieved in which the bending head can be moved into an active operating position in which it protrudes into the travel path of the cutting device, and out of the latter into an inactive end position in which it is arranged completely outside the travel path, and vice versa and, as a result of this departure from the travel path, the usable travel length of the travel path is increased so that the area of the travel path into which the bending head protrudes in its operating position can then also be completely or also only partly traversed.

What is claimed:

1. A bending apparatus for rod-shaped workpieces, comprising:

a bending head having a mandrel rotatable about a rotation axis, the bending head moveable between an operating position, in which the bending head comprises an operating area and operably engages the respective workpiece, and an inactive end position remote therefrom;

a feed device and a straightening device, the feed and straightening devices operably located in an axial direction from the bending head; and a cutting device for cutting the respective workpiece in a cutting plane;

wherein the cutting device is configured such that it is moveable along a cutting device travel path that runs parallel to the feed direction of the workpieces;

wherein the bending head is mounted in a bending-head housing which has an opening on top through which the bending head can be moved into the bending-head housing to occupy its inactive end position, or moved out of the bending-head housing to occupy its operating position, with the bending head in its operating position being located in the cutting device travel path, and in its inactive end position being positioned outside the cutting device travel path; and wherein the cutting device is also situated on the bending-head housing on top of which the cutting device can be moved in a downstream direction along the cutting device travel path towards the location of the bending head such that the cutting device can be moved over at least part of the width of said opening when the bending head is retracted into the bending-head housing through said opening.

2. The bending apparatus of claim 1, wherein the cutting device is moveable in the downstream direction such that the cutting plane is located upstream of the position of the rotation axis of the mandrel of the bending head in its operating position.

3. The bending apparatus of claim 1, wherein the cutting device is moveable in the downstream direction such as to completely traverse the operating area of the bending head when the bending head is in the inactive end position.

4. The bending apparatus of claim 1, wherein the cutting device is moveable in the downstream direction such that at least a portion of the cutting device is located beyond the operating area of the bending head.

5. The bending apparatus of claim 4, wherein the cutting device is moveable in the downstream direction as far as an end of a machine frame of the bending apparatus.

6. The bending apparatus of claim 1, wherein the bending head is moveable between the operating position and the inactive end position along a direction of the rotation axis of the mandrel.

7. The bending apparatus of claim 1, the cutting device comprising a support arm aligned generally perpendicular to the feed direction of the workpiece.

8. The bending apparatus of claim 7, wherein the support arm has a movable cutting blade, and a stationary counter-blade, the cutting blade and the stationary counter-blade defining the cutting plane.

9. The bending apparatus of claim 8, wherein the stationary counter-blade is fixed to the support arm in the feed direction of the workpiece.

10. The bending apparatus of claim 9, wherein the support arm protrudes as far as the respectively conveyed workpiece.

11. The bending apparatus of claim 9, wherein the support arm of the cutting device is movably supported on one or more linear guides.

12. The bending apparatus of claim 11, wherein the one or more linear guides are proximally located on a machine frame of the bending apparatus.

13. The bending apparatus of claim 12, wherein the bending-head housing is movably attached to the machine frame parallel to the feed direction of the workpiece.

14. An apparatus comprising:

a bending head having a mandrel rotatable about a rotation axis, the bending head moveable to one or more positions located between an operating position and an inactive end position, wherein the bending head comprises an operating area and is capable of operably engaging a workpiece in the operating position;

a means for straightening and feeding the workpiece in a feed direction towards the bending head; and a cutting device having a cutting plane, the cutting device configured to cut the workpiece at a desired location on the workpiece;

wherein the cutting device is moveable to one or more positions along a travel path located between a cutting position and a retracted position; and wherein the bending head is mounted in a bending-head housing which has an opening on top through which the bending head can be moved into the bending-head housing to occupy its inactive end position, or moved out of the bending-head housing to occupy its operating position, with the bending head in its operating position being located in the cutting device travel path, and in its inactive end position being positioned outside the cutting device travel path; and wherein the cutting device is also situated on the bending-head housing on top of which the cutting device can be moved in a downstream direction along the cutting device travel path towards the location of the bending head such that the cutting device can be moved over at least part of the width of said opening when the bending head is retracted into the bending-head housing through said opening.

15. The apparatus of claim 14, the cutting device comprising a support arm aligned generally perpendicular to the feed direction of the workpiece, the support arm having a movable cutting blade and a stationary counter-blade fixed to the support arm in the feed direction of the workpiece.

16. The apparatus of claim 15, wherein the cutting plane is located in a location upstream of the position of the rotation axis of the mandrel of the bending head in its operating position.

17. The bending apparatus of claim 15, wherein the cutting device completely traverses the operating area of the bending head when the bending head is in the inactive end position.

18. The bending apparatus of claim 15, wherein at least a portion of the cutting device is located beyond the operating area of the bending head when the bending head is in the inactive end position.

* * * * *